US008763210B2

(12) United States Patent
Vincent et al.

(10) Patent No.: US 8,763,210 B2
(45) Date of Patent: Jul. 1, 2014

(54) LOCKING DEVICE FOR A BUCKLE

(75) Inventors: Stephen Vincent, Wendake (CA); Rino Bourgoin, Quebec (CA); Gaetan Légaré, Wendake (CA)

(73) Assignee: GV Snowshoes (CA)

( * ) Notice: Subject to any disclaimer, the term of this patent is extended or adjusted under 35 U.S.C. 154(b) by 0 days.

(21) Appl. No.: 13/522,120

(22) PCT Filed: Jan. 14, 2011

(86) PCT No.: PCT/CA2011/000044
§ 371 (c)(1),
(2), (4) Date: Sep. 21, 2012

(87) PCT Pub. No.: WO2011/085485
PCT Pub. Date: Jul. 21, 2011

(65) Prior Publication Data

US 2013/0008056 A1 Jan. 10, 2013

Related U.S. Application Data

(60) Provisional application No. 61/295,359, filed on Jan. 15, 2010.

(51) Int. Cl.
*A43C 11/14* (2006.01)
*A43B 5/04* (2006.01)

(52) U.S. Cl.
USPC ..... 24/68 SK; 24/71 SK; 36/50.5

(58) Field of Classification Search
USPC ..... 24/68 SK, 69 SK, 70 SK, 71 SK, 68 CD, 24/170, 191, 193, 311; 36/50.5
See application file for complete search history.

(56) References Cited

U.S. PATENT DOCUMENTS

| | | | | |
|---|---|---|---|---|
| 3,662,435 | A | 5/1972 | Allsop | |
| 4,683,620 | A * | 8/1987 | Valsecchi et al. | 24/71 SK |
| 5,416,952 | A * | 5/1995 | Dodge | 24/68 R |
| 5,745,959 | A * | 5/1998 | Dodge | 24/68 SK |
| 5,779,259 | A | 7/1998 | Lin | |
| 5,887,318 | A * | 3/1999 | Nicoletti | 24/71 SK |

(Continued)

FOREIGN PATENT DOCUMENTS

WO 9520334 A1 8/1995

OTHER PUBLICATIONS

International Search Report for Application No. PCT/CA2011/000044 dated Apr. 26, 2011.

*Primary Examiner* — Robert J Sandy
*Assistant Examiner* — Tyler Johnson
(74) *Attorney, Agent, or Firm* — Lerner, David, Littenberg, Krumholz & Mentlik, LLP

(57) ABSTRACT

Disclosed is a locking device for a buckle. The device comprises a housing, a lever and an arm. The lever has a first strap engaging end and a locking portion. The lever is connected to the housing for movement relative to the housing. The locking portion is cooperable with the housing to be retained in it. The housing is configured to receive a strap. The arm is resiliently connected to the housing and has a second strap engaging end and a lifting end portion. The lifting end portion is disposed towards the first strap engaging end, such that in a locked position, when the locking portion cooperates with the housing, the second strap engaging end is urged into engagement with the strap. The lifting end portion contacts the first strap engaging end to lift it away from the strap.

23 Claims, 12 Drawing Sheets

(56) References Cited

U.S. PATENT DOCUMENTS

| | | | | |
|---|---|---|---|---|
| 6,175,994 | B1 * | 1/2001 | Nicoletti | 24/68 SK |
| 6,374,464 | B1 * | 4/2002 | Lai | 24/68 SK |
| 6,554,297 | B2 * | 4/2003 | Phillips et al. | 280/14.22 |
| 6,561,398 | B1 * | 5/2003 | Cole et al. | 224/324 |
| 6,729,047 | B2 * | 5/2004 | Hirayama | 36/50.5 |
| 6,748,630 | B2 * | 6/2004 | Livingston | 24/68 SK |
| 6,859,981 | B2 * | 3/2005 | Hsiao | 24/68 SK |
| 7,086,122 | B2 | 8/2006 | Livingston | |
| 7,232,147 | B2 * | 6/2007 | Couderc | 280/623 |
| 7,802,808 | B2 * | 9/2010 | Neiley | 280/623 |
| 7,877,845 | B2 * | 2/2011 | Signori | 24/68 SK |
| 7,963,546 | B2 * | 6/2011 | Veyrat-Charvillon | 280/634 |
| 8,348,113 | B2 * | 1/2013 | Huang | 224/567 |
| 2002/0189056 | A1 * | 12/2002 | Gallina et al. | 24/68 R |
| 2004/0211039 | A1 * | 10/2004 | Livingston | 24/68 SK |
| 2007/0246914 | A1 | 10/2007 | Neiley | |
| 2011/0290840 | A1 * | 12/2011 | Huang | 224/539 |

* cited by examiner

LOCKING DEVICE FOR A BUCKLE

CROSS REFERENCE TO RELATED APPLICATIONS

The present application is a national phase entry under 35 U.S.C. §371 of International Application No. PCT/CA2011/000044, filed Jan. 14, 2011, published in English, which claims the benefit of U.S. Provisional Application No. 61/295,359, filed Jan. 15, 2010. The disclosures of said applications are incorporated by reference herein.

FIELD OF THE INVENTION

The present concerns a locking device for a buckle useful for footwear.

BACKGROUND

Ratchet type buckles are used in many types of sport gear such as snowboard bindings, ski boots and snowshoe harnesses. Typically, ratchet type buckles include a lever with a toothed end that is used to move a toothed strap, known as a ladder strap, through a housing so as to adjust the tension in the strap thereby allowing a tight, yet comfortable fit of the strap around the footwear to secure it. A locking mechanism is usually associated with the buckle to permit the strap to be locked in place once the desired fit is achieved. This type of buckle is especially useful for use in cold weather because it allows a user to quickly loosen and tighten the strap whilst wearing gloves or when the user's fingers are cold.

A number of different ratchet type buckles are known, examples of which are described in U.S. Pat. Nos. 7,086,122; 5,779,259 and 3,662,435. However, these buckles have a number of drawbacks. For example, the buckles include locking mechanisms which are complex and include a number of movable parts, which are easily damaged or fouled by dirt or ice. Also, because of their complexity, these buckles are expensive to manufacture and require specialized equipment for their assembly.

Thus, there is a need for an improved locking device for a ratchet type buckle.

SUMMARY OF THE INVENTION

Accordingly, in one aspect there is provided a locking device for a buckle, the device comprising:

a) a housing;

b) a lever having a first strap engaging end and a locking portion, the lever being connected to the housing for movement relative thereto, the locking portion being cooperable with the housing to be retained therein, the housing being configured to receive therein a strap; and c) an arm resiliently connected to the housing, the arm having a second strap engaging end and a lifting end portion, the lifting end portion being disposed towards the first strap engaging end, such that in a locked position, when the locking portion cooperates with the housing, the second strap engaging end is urged into engagement with the strap, the lifting end portion contacts the first strap engaging end to lift it away from the strap.

In one example, in an open position, the locking portion is moved away from the housing to locate the lever substantially orthogonal to the housing, the first strap engaging end engages the strap and is located away from the lifting end portion, the second strap engaging end being engaged with the strap. In a release position, the lever is angled away from the housing such that the first engaging end contacts the lifting end portion to disengage the second strap engaging end from the strap to permit movement of the strap away from the housing. The lever is movable towards and away from the housing so as to advance the strap through the housing.

In another example, a) the housing has a base, first and second opposing sidewalls extending generally orthogonally relative to the base, the housing having first and second axes, the first axis being generally orthogonal to the second axis, each sidewall having a connecting slot located therein, each slot being angled away from the first axis; and b) each sidewall includes a guide ramp and a locking opening, the guide ramp being angled towards the locking opening and away from the first axis for receiving the locking portion of the lever. The housing further includes a cross wall connected to, and extending between, the first and second opposing sidewalls, the arm being resiliently connected to the cross wall.

In another example, a resilient member connects the cross wall and the arm.

In another example, the lever has two connecting portions extending outwardly therefrom, the connecting portions each being connected to the connecting slots to permit pivotable movement of the lever relative to the housing and to permit axial movement of the lever along the first axis. Each connecting portion is a connecting pin. The locking portion of the lever includes two engaging pins extending outwardly therefrom, each engaging pin being sized and shaped to engage the respective guide ramps and to releasably engage the locking openings in the locking position.

In one example, the arm is Z-shaped in cross section, the lifting portion being disposed towards the lever, the second engaging end being disposed towards the strap, the second engaging portion being substantially parallel to the base and moveable relative thereto. The arm includes an arm axis disposed orthogonal to the base, the lifting portion is a first lip angled towards the base, the second engaging end is a second lip angled away from the base.

In one example, the first engaging end includes one or more teeth.

In another example, the first engaging end includes first and second teeth located generally orthogonal to each other for engaging the strap.

In one example, the second engaging end includes a tooth being connected to a face of the second lip and disposed towards the base.

In one example, the strap is a ladder strap.

In another example, the lever has a first surface disposed towards the base, the first surface being shaped to engage the housing so as to define a cavity in the housing.

In one example, the lever further includes a gripping end, the gripping end being wider than the first strap engaging end to permit a user to move the lever.

In another example, the buckle is a ratchet-type buckle.

In another example, the first lip includes a notch for engagement with the first strap engaging end so as to hold the second strap engaging end away from the strap in a release position.

In another aspect, there is provided a buckle comprising the locking device, as described above.

In another aspect, there is provided a harness comprising the locking device, as described above.

In another aspect, there is provided footwear comprising the locking device, as described above. The footwear includes a snowshoe, a ski boot, a hiking boot, a snowboard boot, a rollerblade boot, or ice skates.

In an alternative aspect, there is provided a ratchet type buckle comprising a housing having a pair of spaced-apart side walls and a bottom wall extending therebetween, the housing being adapted for receiving a ladder strap therein; a pawl resiliently connected to the housing and adapted for engaging with the ladder strap to prevent an outward movement thereof in a first direction in a resting position of the pawl; and a lever pivotally mounted to the housing and pivotable between a first position, a second position and a third position, the lever having a gripping end for actuating the lever between the positions and a toothed opposed front end adapted for snuggly engaging the ladder strap and for moving the ladder strap in a second direction opposed to the first direction when the lever is actuated between the first position and the second position, the toothed front end being further adapted for urging the pawl out of engagement with the ladder strap for releasing the ladder strap from the housing when the lever is in the third position.

These and other objects, advantages and features of the present discovery will become more apparent to those skilled in the art upon reading the details of the discovery more fully set forth below.

BRIEF DESCRIPTION OF THE DRAWINGS

In order that the present may be readily understood, examples of the discovery are illustrated in the accompanying drawings.

Figure 1:
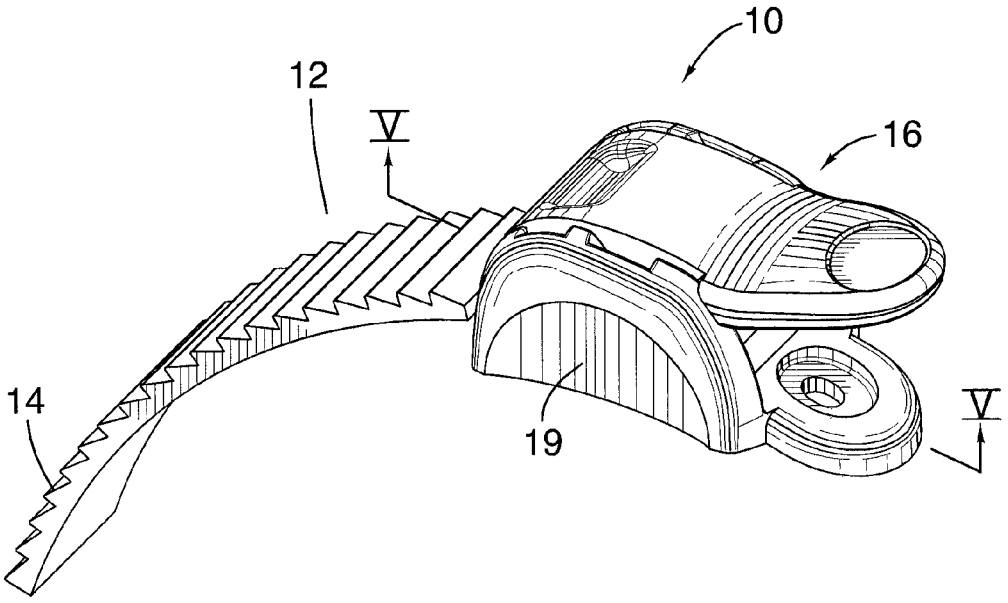
FIG. 1 is a perspective view of a buckle showing a lever with a ladder strap in a locked position.

Further details of the discovery and its advantages will be apparent from the detailed description included below.

DETAILED DESCRIPTION

Referring to FIGS. 1, 2, 3 and 4, there is shown a ratchet type buckle assembly 10. The buckle assembly 10 comprises a ratchet type buckle 16 and a ladder strap 12 which has a plurality of transverse teeth 14 extending substantially along the entire length of one side of the strap. A locking device for the ratchet type buckle, is shown generally at 11 and comprises a housing 18, a lever 20 and an arm (or pawl) 30, the locking device being useful for holding the ladder strap 12 under tension. The housing 18 includes a base (or bottom wall) 22, first and second opposing sidewalls 24*a*, 24*b* extending generally orthogonally relative to the base 22. The housing 18 has two axes 21*a*, 21*b*; the first axis 21*a* is generally orthogonal to the second axis 21*b*. The second axis 21*b* longitudinally bisects the housing 18.

Figure 3:
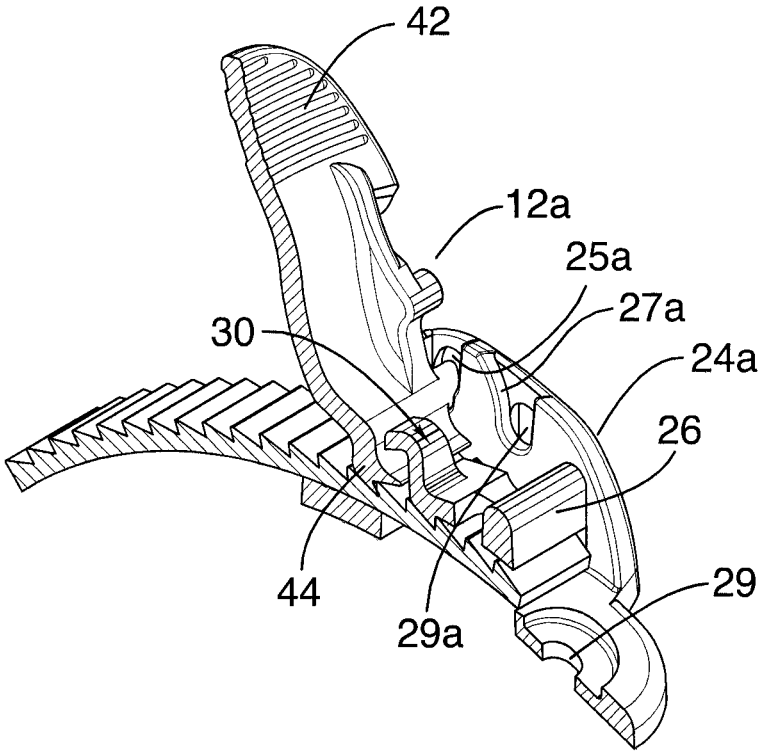
FIG. 3 is a perspective cross-sectional view of the buckle taken along line III-III of FIG. 2.
Figure 4:
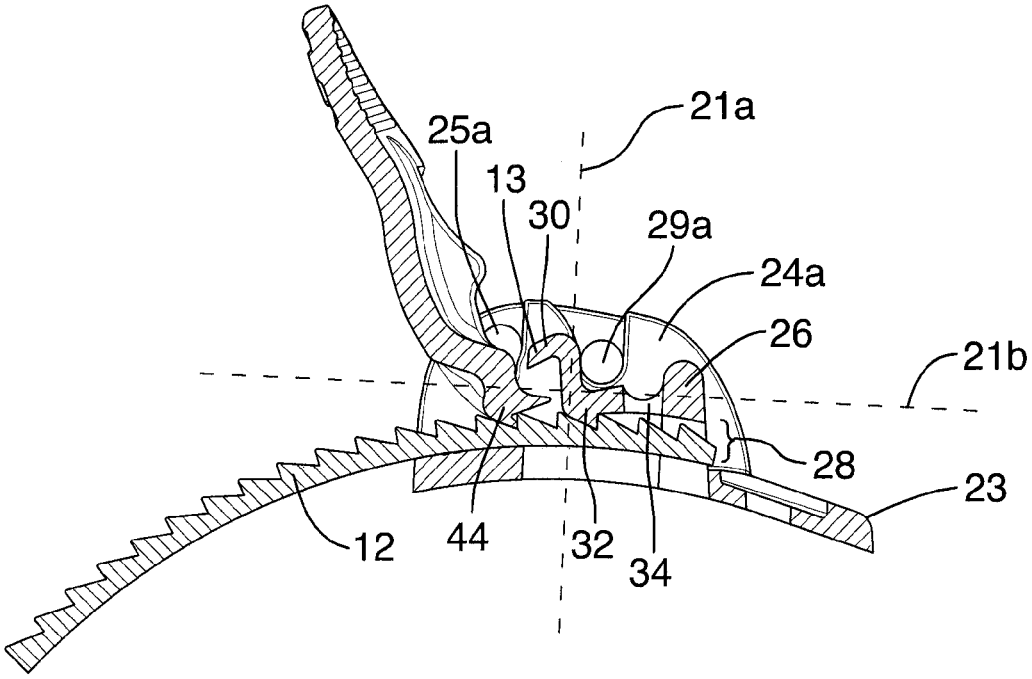
FIG. 4 is a cross-sectional view of the buckle taken along line III-III of FIG. 2 showing axes.
Figure 8:
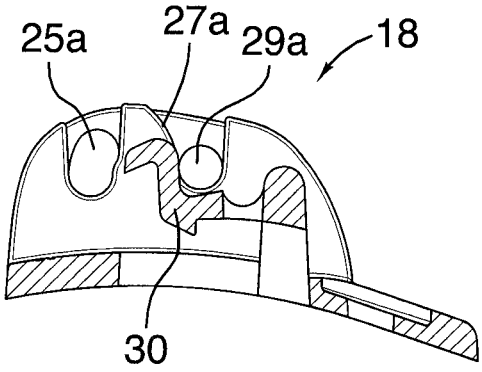
FIG. 8 is a side cross-section view of a housing of a buckle in accordance with one embodiment.
Figure 9A:
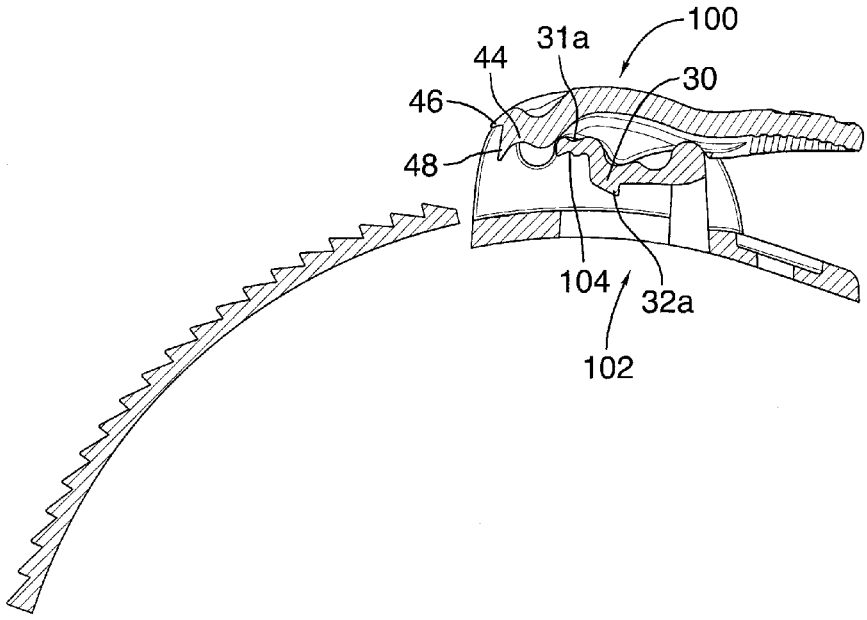
FIGS. 9A to 9D illustrate an alternative buckle assembly.
Figure 9B:
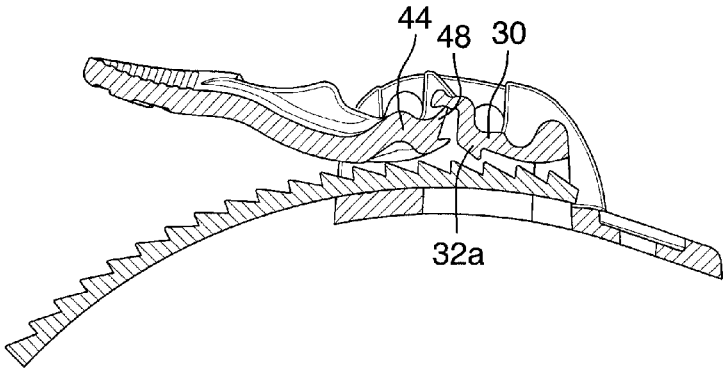
Figure 9C:
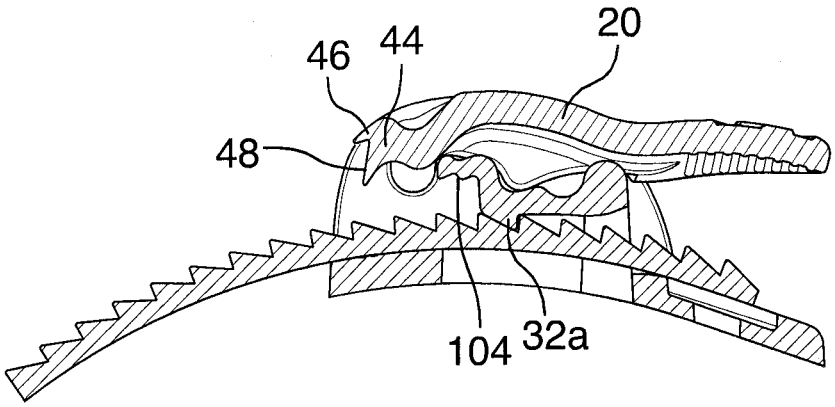
Figure 9D:
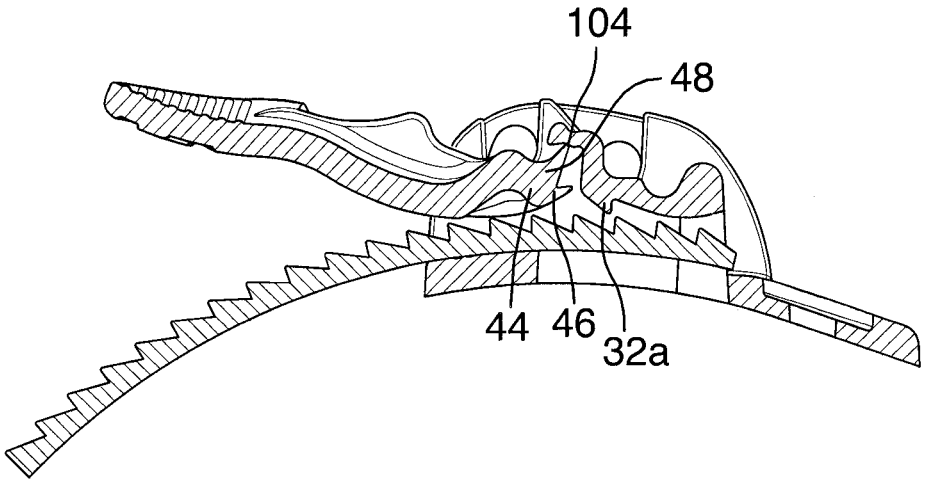

Referring to FIGS. 3, 4 and 8, each of the side walls 24*a*, 24*b* of the housing 18 is provided with a connecting slot 25*a*, 25*b* for connecting the lever 20 to the housing 18 and allowing pivot movement as well as axial movement generally along the first axis 21*a* relative thereto. Each of the side walls 24*a*, 24*b* is also provided with a locking ramp 27*a*, 27*b* terminating into a circular, locking opening 29*a*, 29*b* for locking the lever 20 in the closed position and preventing an unwanted movement thereof. The slots 25*a*, 25*b* have an elongated shape, which may be rectangular, and which are inclined rearwardly away from the first axis 21*a*. The guide ramps 27*a*, 27*b* are angled towards the locking openings 29*a*, 29*b* and away from the first axis 21*a* for receiving a locking portion 12*a* of the lever 20. The housing 18 also includes a cross wall member 26 connected to, and extending between, the first and second opposing sidewalls 24*a*, 24*b*. The arm 30 is resiliently connected to the cross wall member 26 using a resilient spring member 34 thereby resiliently connecting the arm 30 to the housing 18. The arm 30 may be connected to the housing 18 using any other resilient connections known to those skilled in the art. The skilled addressee will also appreciate that two or more adjacent arms 30 may be provided. The cross wall member 26 is located above the base 22 and defines a space 28 therebetween to permit movement of the strap between the cross wall 26 and the base 22. The housing 18 is generally U-shaped in cross section with a distance separating the two sidewalls 24*a*, 24*b* sufficient to permit easy movement of the strap therethrough.

As best seen in FIG. 1, a recess 19 is located on the external face of the housing 18 to permit gripping of the housing 18 by a user during insertion of the ladder strap into the housing 18.

In one example, the base 22 is curved to adapt to the contour of a user's footwear, such as a boot, and to provide enhanced comfort when the ladder strap 12 is tightened. A person skilled in the art will appreciate that depending on the use of the buckle assembly 10; the shape or form of the base 22 may vary. For example, the base 22 may be flat.

Figure 2:
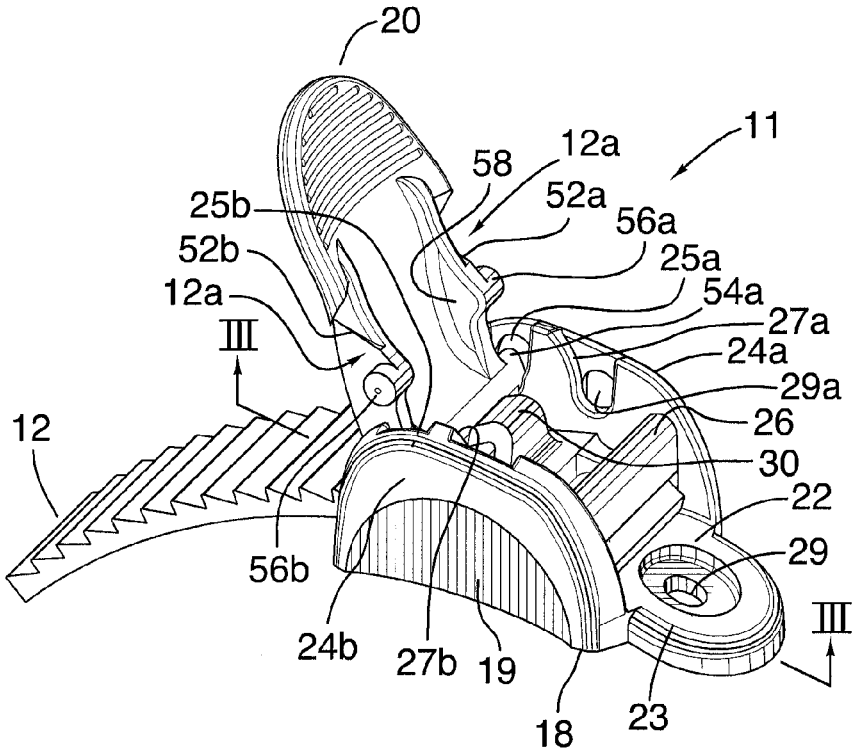
FIG. 2 is a perspective view of the buckle with the lever in an open position.

As best illustrated in FIG. 2, the bottom wall 22 extends rearwardly, beyond the back ends of the side walls 24*a*, 24*b* so as to define a mounting portion 23 for mounting the buckle 16 onto a harness of a snowshoe (not shown) or the like. In the example illustrated, the mounting portion 23 includes a flanged hole 29 for receiving a fastener, such as a rivet or a bolt (not shown), to secure the buckle 16 to the harness (not shown). In one example, the flanged hole 29 is configured to receive the head of the fastener to eliminate interference with the ladder strap 12 as it moves through the housing 18. A skilled person will appreciate that various other configurations may be considered for securing the ratchet type buckle 16 to the harness.

Referring to FIGS. 2, 3 and 4, the lever 20 includes a first strap engaging end 44 (a toothed front end) and the locking portion 12*a*, and is connected to the housing 18 for movement relative thereto. The locking portion 12*a* is cooperable with the housing 18 to be retained therein.

Figure 7A:
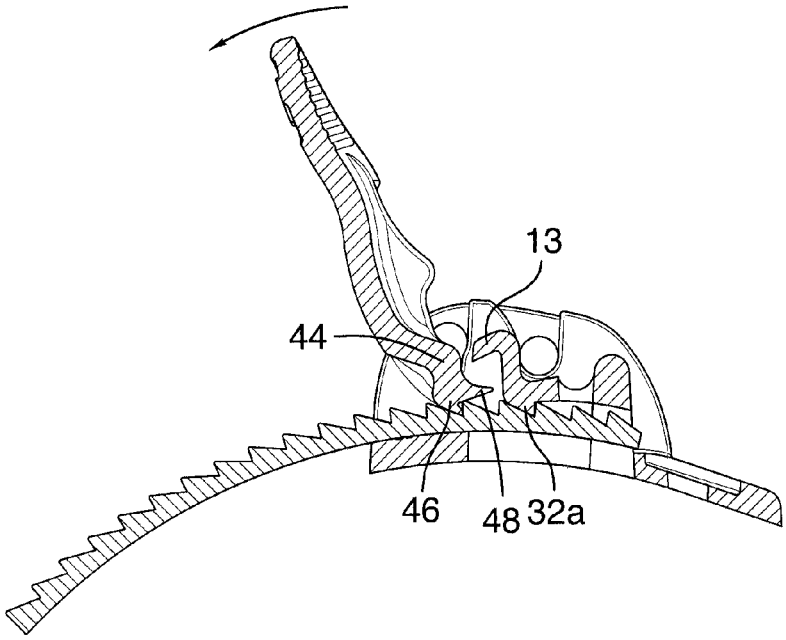
FIGS. 7A to 7C illustrate a ladder strap release operation.

Referring to FIGS. 3 and 4, the arm 30 includes a second strap engaging end 32 and a lifting end portion 13. The lifting end portion 13 is disposed towards the first strap engaging end 44, such that in a locked position, when the locking portion 13 cooperates with the housing 18, the second strap engaging end 32 is urged into engagement with the strap 12, and the lifting end 13 contacts the first strap engaging end 44 to lift it away from the strap 12. The arm 30 extends frontwardly from the cross-member 26. The arm 30 is configured for engaging one of the teeth 14 of the ladder strap 12 and holding the same when in a resting position of the arm 30, and comprises a bottom tooth 32 configured for engaging the teeth 14 of the ladder strap 12, and the lifting end portion 13. The arm 30 is connected to the cross-member 26 of the housing 18 via the resilient spring member 34 configured to urge the arm 30 toward the bottom wall 22 (i.e. against the ladder strap 12 engaged in the housing 18) to permit the bottom tooth 32 to engage one of the teeth 14 of the ladder strap 12 while allowing resilient upward movement of the arm 30 to disengage the ladder strap 12 when the lever 20 is moved in the released position as shown in FIG. 7C, as described below.

Figure 5:
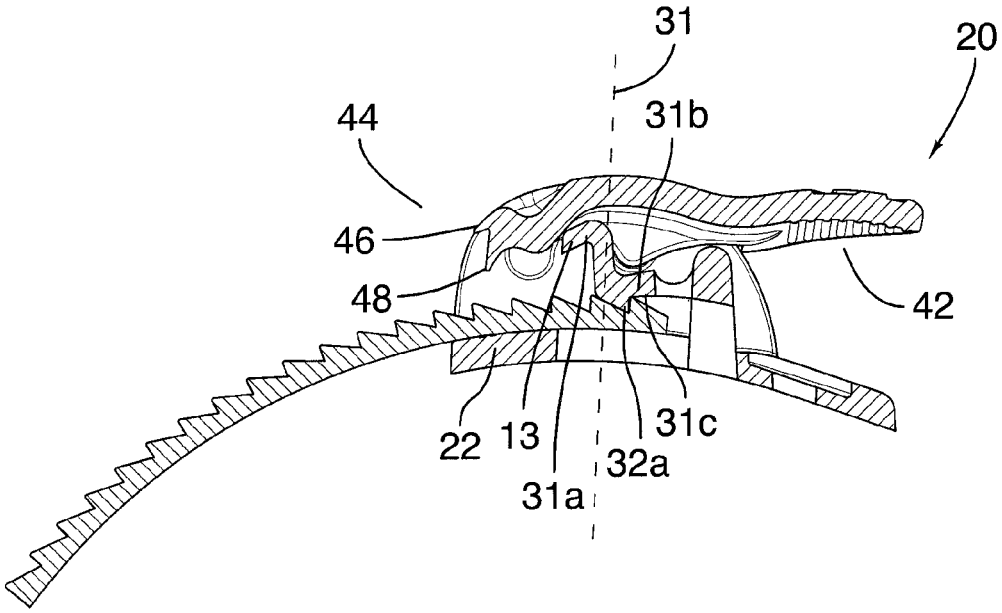
FIG. 5 is a cross-sectional view of the buckle taken along line V-V of FIG. 1.

As best seen in FIG. 5, the arm 30 is generally Z-shaped in cross section, the lifting end portion 13 is disposed towards the lever 20 and the second engaging end 32 is disposed towards the strap 12. The second engaging portion 32 is substantially parallel to the base 22 and is moveable relative thereto. The arm 30 includes an arm axis 31 disposed orthogonal to the base 22. The lifting end portion 13 includes a first lip 31*a* angled towards the base 22. The second engaging end 32 includes a second lip 31*b* angled away from the base 22. The second engaging end 32 includes the tooth 32*a* being connected to a face 31*c* of the second lip 31*b* and disposed towards the base 22.

Referring again to FIGS. 1 and 2, the lever 20 is pivotally connected to the housing 16 for movement relative to the housing 18 and to be pivotable between a first position, a second position and a third position. FIG. 1 shows the lever 20 is the first position, also called the closed or locked position, while FIG. 2 shows the lever 20 in the second position, also called the open position. FIG. 7C, which will be described in more detail below shows the lever 20 in the third position, also called the released position. In the open position, the locking portion 12*a* is moved away from the housing 18 to locate the lever 20 substantially orthogonal to the housing 18. The first strap engaging end 44 engages the strap 12 and is located away from the lifting end portion 13 and the second strap engaging end 32 is engaged with the strap 12. In the release position, the lever 20 is angled away from the housing 18 such that the first engaging end 44 contacts the lifting end portion 13 to disengage the second strap engaging end 32 from the strap 12 to permit movement of the strap 12 away from the housing 18. The lever 20 is movable towards and away from the housing 18 so as to advance the strap 12 through the housing 18.

Referring now to FIGS. 3 to 5, the lever 20 has a gripping end 42 to permit a user to actuate the lever 20 between the three different positions and a first strap engaging end 44 (a toothed front end) adapted for engaging with the ladder strap 12 and moving the ladder strap 12 in a second direction opposed to the first direction when the lever 20 is actuated from the first position shown in FIG. 1 to the second position shown in FIG. 2. The gripping end 42 of the lever 20 is shaped to permit operation of the buckle 16 by a user and to enhance lever action. Accordingly, the gripping end 42 is slightly wider than the toothed front end 44 and is provided with gripping elements on both on top and bottom sides. The top face of the gripping end 42 may be provided with the logo of the manufacturer.

As illustrated in FIGS. 1 through 7C, the toothed front end 44 is provided with first and second teeth 46, 48 for engaging the teeth 14 of the ladder strap 12. The tooth 46 extends generally frontwardly from the front end 44 while the tooth 48 extends generally downwardly, substantially orthogonal to the tooth 46.

Figure 6A:
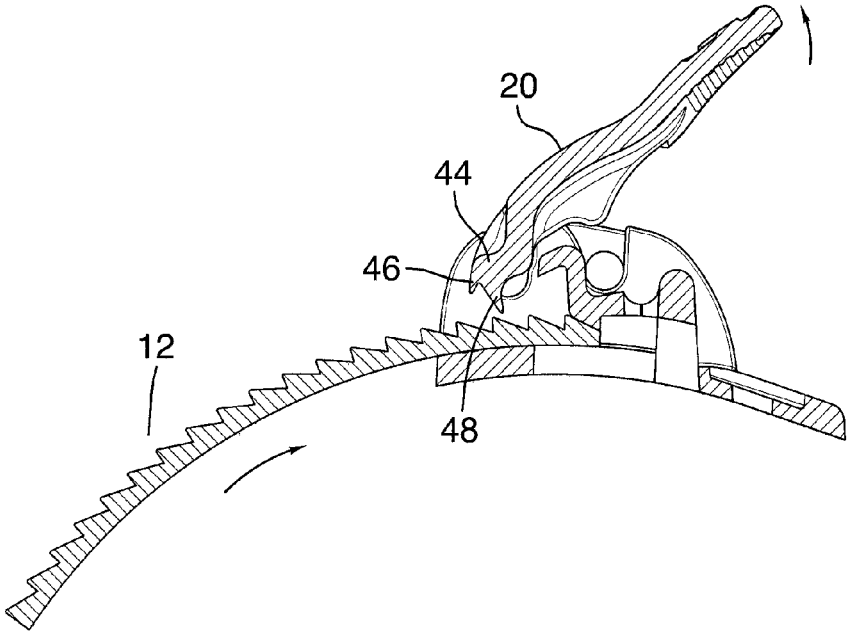
FIGS. 6A to 6E illustrate a ladder strap tightening operation.
Figure 6B:
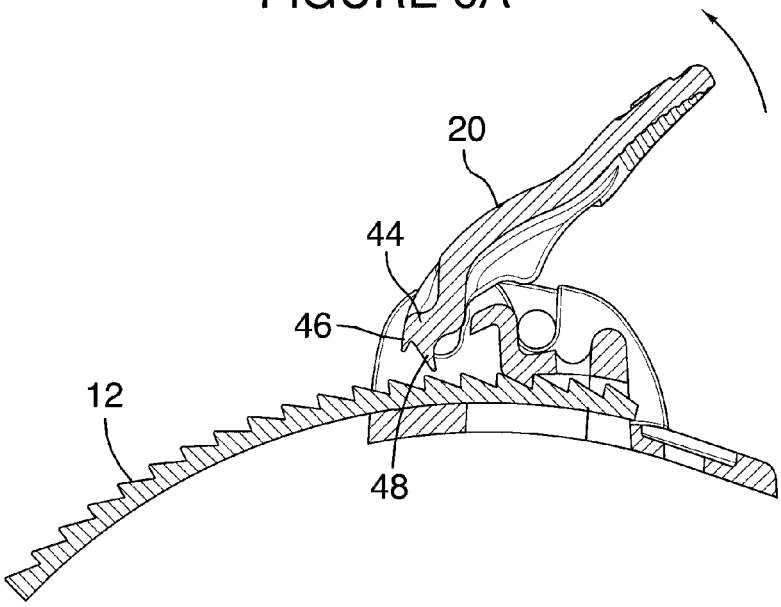
Figure 6C:
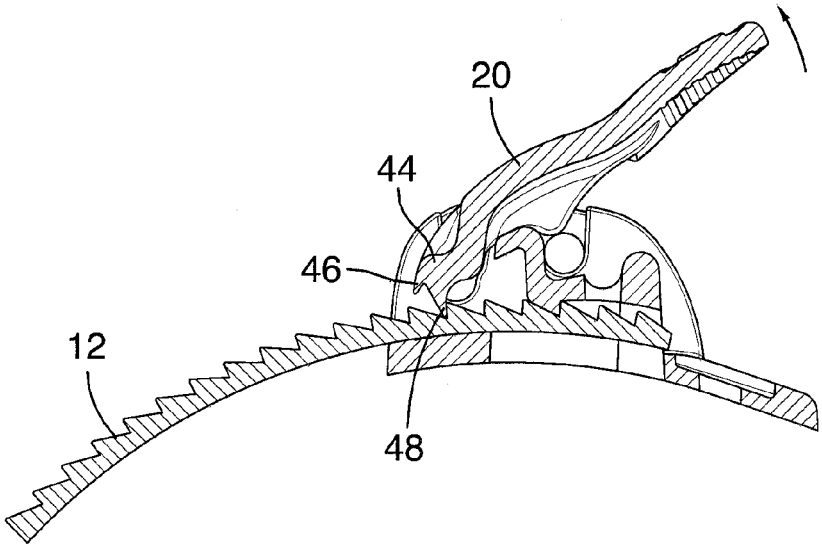
Figure 6D:
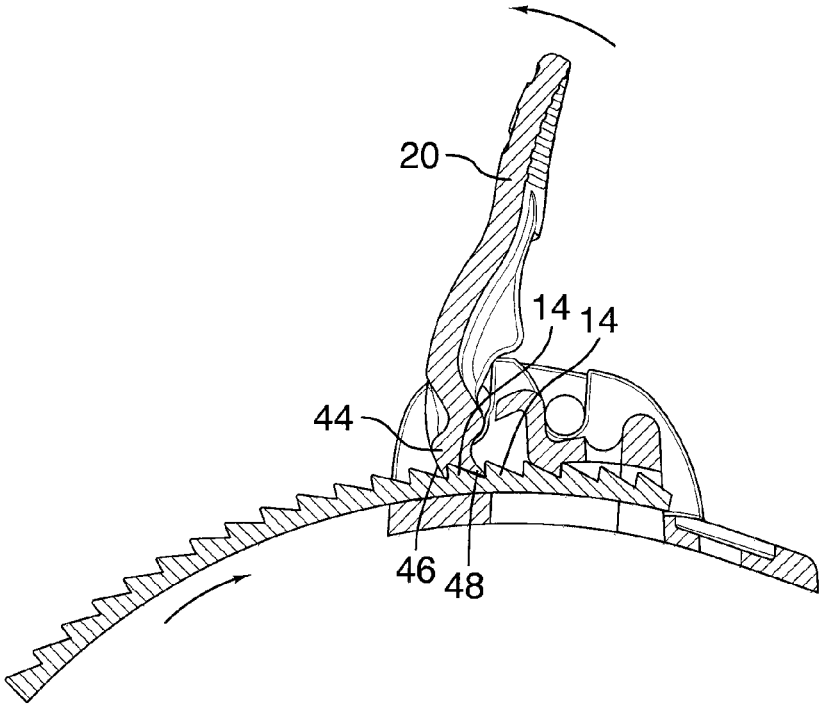
Figure 6E:
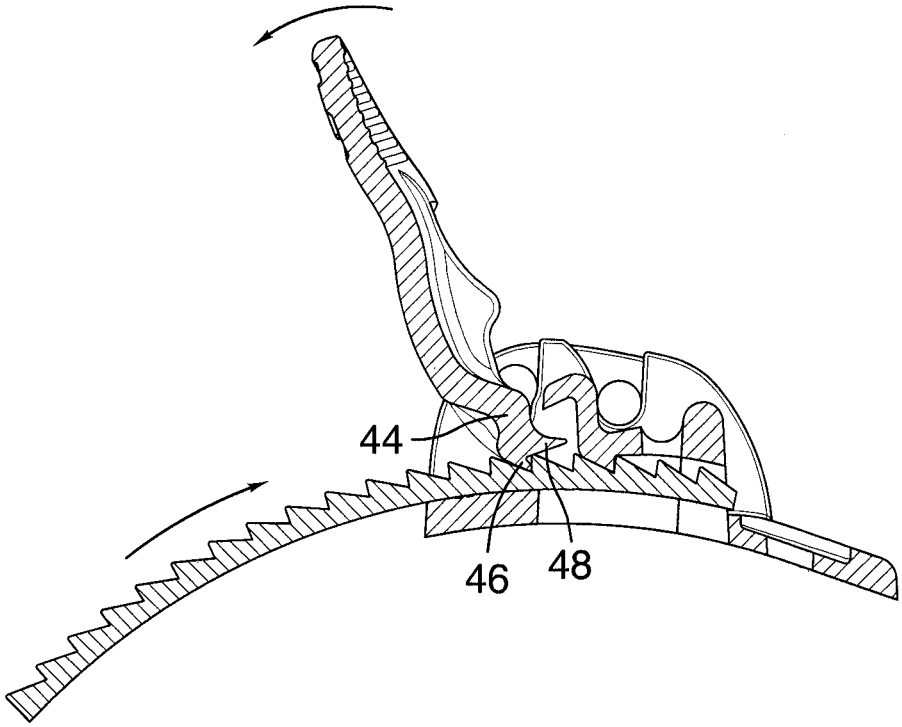

As best illustrated in FIG. 6D, the orthogonal relationship between the teeth permits the toothed front end 44 to engage two adjacent teeth 14 of the ladder strap 12 when the lever 20 is moved from the closed position (shown in FIG. 1) to the open position (shown in FIG. 2) to tighten the strap, thereby enhancing engagement with the ladder strap 12. This configuration also permits a greater advance of the ladder strap 12 through the housing 18 when the lever is actuated between the first and the second positions, which is advantageous since it may ease use of the buckle 16. Indeed, the toothed front end 44 provided with the pair of teeth 46, 48 may also permit the advance of two or three transverse teeth 14 of the ladder strap 12 with a single movement of the lever 20 between the first and the second position.

The skilled addressee will appreciate that although the toothed front end 44 is illustrated with two teeth 46, 48, any number of teeth can be used without deviating from the scope of this discovery.

The toothed front end 44 is further adapted for urging the arm 30 out of engagement with the ladder strap 12 for releasing the ladder strap 12 from the housing 18 when the lever 20 is in the third position, as shown in FIG. 7C and detailed below.

Figure 7B:
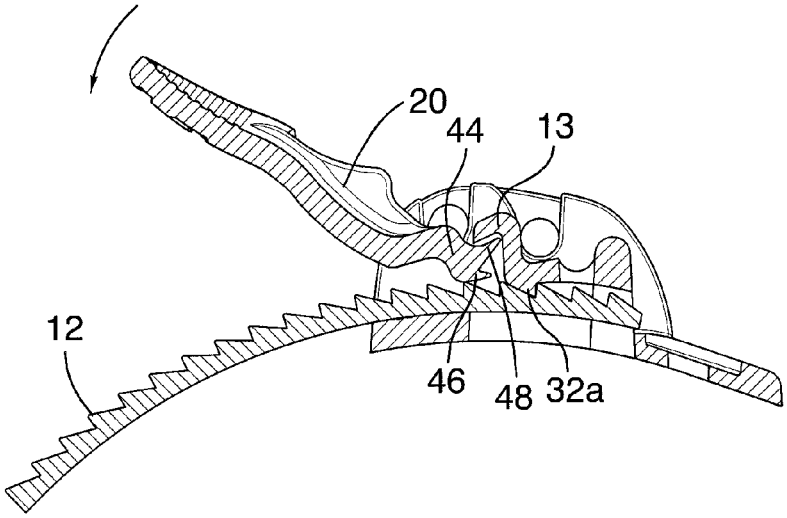
Figure 7C:
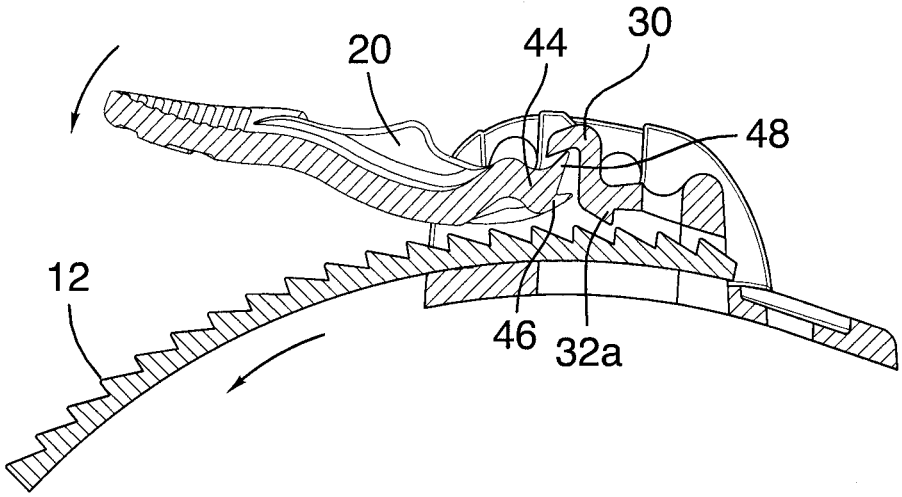

As best shown in FIGS. 7B and 7C, the toothed front end 44 also permits the tooth 48 to engage the lifting end portion 13 of the arm 30 when the lever 20 is moved from the open position toward the released position (shown in FIG. 7C) and to lift the same, thereby disengaging the bottom tooth 32*a* of the arm 30 from the teeth 14 of the ladder strap 12 and allowing backward movement of the ladder strap 12 in the first direction.

As best illustrated in FIG. 4, the bottom wall 22, the side walls 24*a*, 24*b*, the cross-member 26, the arm 30 and the resilient spring member 34 form a unitary, integral structure. The housing 18 may be manufactured from a plastic material, for example by plastic injection or plastic molding using known techniques. A person skilled in the art will also appreciate that the housing 18 may be made from any other suitable material and using any other known suitable techniques. For example, where the housing is submitted to extreme wear and shock, it may be manufactured from aluminum by machining as a non-limitative example. In this case, the arm 30 may be manufactured separately and assembled to the housing 18.

Referring again to FIGS. 1 and 5, when the lever 20 is in the closed position, the gripping end 42 is in substantial alignment with the back ends of the side walls 24*a*, 24*b*. The body of the lever 20 and the upper edge of the side walls 24*a*, 24*b* extend flush with each other, which is of great advantage since it may prevent an inadvertent opening of the buckle 16 by an external element which may hook the lever 20.

Referring now to FIGS. 2 and 3, the locking portion 12*a* includes a pair of spaced-apart side walls 52*a*, 52*b*. Extending from each of the side walls 52*a*, 52*b*, proximal to the toothed front end 44, are generally cylindrical pivot pins 54*a*, 54*b*. The pivot pins 54*a*, 54*b* are configured for being received in the slots 25*a*, 25*b* of the side walls 24*a*, 24*b* and for pivotally mounting the lever 20 to the housing 18. The locking portion 12*a* is cooperable with the housing 18 to be retained therein.

As best illustrated in FIGS. 1 and 2, located between the toothed front end 44 and the gripping end 42 of the lever 20 are locking pins 56*a*, 56*b*. The locking pins 56*a*, 56*b* extend from the side walls 52*a*, 52*b* of the lever 20 and are in alignment with the locking ramps 27*a*, 27*b* and the locking holes 29*a*, 29*b* for engaging the locking ramps 27*a*, 27*b* when the lever 20 is moved from the open position toward the closed position and snapping into the locking holes 29*a*, 29*b* for locking the lever 20 in the closed position.

The slots 25*a*, 25*b* have an elongated shape and are inclined rearwardly. Thus, when the lever 20 is pivoted between the first position and the second position, the shape of the slots 25*a*, 25*b*, in combination with the locking ramps 27*a*, 27*b* acting as guiding elements, also permit a orthogonal movement of the lever 20 with respect to the housing 18. When the lever 20 extends in the first position, the pivot pins 54*a*, 54*b* extend in the upper portion of the slots 25*a*, 25*b*. When the lever 20 extends in the second position, the pivot pins 54*a*, 54*b* extend in the lower portion of the slots 25*a*, 25*b*. The skilled addressee will therefore appreciate that the ramps 27*a*, 27*b* guide the pivot pins 54*a*, 54*b* in the slots 25*a*, 25*b*.

The skilled addressee will nevertheless appreciate that various other arrangements for pivotally mounting the lever 20 to the housing 18 may be envisaged. Similarly, various other arrangements may also be considered for securing the lever 20 in the closed position.

The side walls 52*a*, 52*b* of the lever 20, on the bottom face thereof, define a cavity 58. The cavity 58 is adapted to receive therein the top, lifting end portion 13 of the arm 30 when the lever 20 is in the closed and locked position, as shown in FIGS. 2 and 5 and not to interfere with the arm 30. The skilled addressee will appreciate that the lever 20, when in the closed and locked position, presses on the lifting end portion 13 to prevent release of the ladder strap 12.

The skilled addressee will appreciate that this arrangement, when manufactured from plastic or similar substantially soft material, may provide a self releasing mechanism of the lever 20 when the ladder strap 12 is too tightened, as it will become apparent below. The skilled addressee will further appreciate that the lever 20 may be made from other materials, for example, aluminum.

The toothed front end 44, the gripping end 42, the teeth 46, 48 and the pivot and locking pins define a unitary, integral structure. The lever 20 may be manufactured from a plastic material, for instance by plastic injection or plastic molding using known techniques. A person skilled in the art will appreciate that the housing may be made from any other suitable material and using any other known suitable techniques.

To assemble the buckle 16, the lever 20 is aligned with the housing 18 and the pivot pins 54*a*, 54*b* are snapped into the slots 25*a*, 25*b*, thereby pivotally securing the lever 20 to the housing 18. A person skilled in the art will thus appreciate that this configuration allows providing a ratchet type buckle using only two component, namely the housing 18 and the lever 20.

In the example wherein the housing 18 is provided with a cross member 26, the cross member 26 may be mounted away from the slots 25*a*, 25*b* in order to allow sufficient flexibility of the side walls 24*a*, 24*b* for allowing assembling of the lever 20 in the housing 18.

The skilled addressee will appreciate that the ratchet type buckle may be used in various applications. For example, in may be used in combination with a harness. It may also be used in combination with footwear such as a snowshoe, a ski boot or a snowboard binding for non-limitative examples. It may also have applications for bicycle shoes, roller blades and ice skates as well as any other applications wherein a belt type attaching may be convenient.

Operation

Referring now to FIGS. 6A to 6E, the operation of the buckle assembly 16 and the locking device 11 will now be described beginning in the closed (locked position). The lever 20 is moved out of the closed position in a position proximate to the open position and the ladder strap 12 is located in the housing 18 by moving it into the space defined between the toothed front end 44 of the lever 20 and the bottom wall 22 of the housing 18. The lever 20 is then pivoted until the tooth 48 engages a first tooth 14 of the ladder strap 12. The lever 20 is further pivoted toward the open position until the second tooth 46 of the lever 20 engages a second tooth 14 of the ladder strap 12. Further pivot movement of the lever 20 advances the ladder strap 12 further in the housing 18, thereby tightening the buckle assembly 10. To further tighten the ladder strap 12, the lever 20 is moved toward an intermediate position, as shown in FIG. 6B, where the arm 30 is engaged with the teeth 14 of the ladder strap 12 thereby significantly reducing or essentially eliminating rearward movement thereof, and is pivoted again toward the position shown in FIG. 6E. When the ladder strap 12 has been tightened as desired, the lever 20 may be moved into the closed and locked position as best seen in FIG. 1, in which the locking pins 56*a*, 56*b* engage the locking holes 29*a*, 29*b* to significantly reduce or essentially eliminate unwanted pivotal movement of the lever 20. When in the locked position, the arm 30 is maintained against one of the teeth of the ladder strap 12.

The skilled addressee will understand that the shape of the slots 25*a*, 25*b*, in combination with the locking ramps 27*a*, 27*b* permits orthogonal movement of the lever 20 with respect to the housing 18, which prevents the teeth 46, 48 from interfering with the teeth 14 of the ladder strap 12 during the tightening of the strap 12.

Referring now to FIGS. 7A, 7B and 7C, to disengage the ladder strap 12 from the buckle 16, the lever 20 is moved from the closed position toward the released position until the tooth 48 engages the lifting end portion 13 of the arm 30. Further pivoting of the lever 20 toward the released position causes the arm 30 to move upwardly and the tooth 32 to disengage from the teeth 14 of the ladder strap 12, thereby permitting the user to manually pull the ladder strap 12 away from the housing 18.

Alternatives

Referring now to FIGS. 9A to 9D, an alternative example of the ratchet type buckle is shown generally at 100. An alternative locking device 102 is essentially identical to the locking device 11 described above. Only the salient feature of the locking device 102 will be described. In this example, the arm (pawl) 30 includes a notch 104 located at the first lip 31*a* for engaging the toothed end 44 of the lever 20. This additional feature holds the tooth 32*a* away from the strap 12 during insertion of the strap 12 into the housing 18. The tooth 48 from the toothed end 44 and the notch 104 are essentially complementary thereby preventing movement of the tooth 32 during advancement of the strap 12 into the housing 18, which permits the user to easily push the strap 12 into the housing 18. The operation of the alternative locking device 102 is substantially identical to that of the locking device 11.

It should be noted that although the examples throughout illustrate a toothed strap which engages the toothed front end 44 of the lever and of the arm 30, it is to be understood that a non-toothed strap, lever and arm can also be used to achieve the same advantages as described herein. Such an alternative buckle assembly would require a frictional engagement of the lever and the arm with, for example, a strap manufactured from a frictional sheet material.

Although the above description relates to a specific examples as presently contemplated by the inventors, it will be understood that the discovery in its broad aspect is not limited to this specific example and includes mechanical and functional equivalents of the elements described herein.

We claim:

1. A locking device for a buckle, the device comprising:

a) a housing;

b) a lever having a first strap engaging end and a locking portion, the lever being connected to the housing for movement relative thereto, the locking portion being cooperable with the housing to be retained therein, the housing being configured to receive therein a strap; and c) an arm resiliently connected to the housing, the arm having a second strap engaging end and a lifting end portion, the lifting end portion being disposed towards the first strap engaging end, such that in a locked position, when the locking portion cooperates with the housing, the second strap engaging end is urged into engagement with the strap, the lifting end portion contacts the first strap engaging end to lift it away from the strap, wherein in a release position, the lever is angled away from the housing such that the first engaging end contacts the lifting end portion to disengage the second strap engaging end from the strap to permit movement of the strap away from the housing.

2. The device, according to claim 1, in which in an open position, the locking portion is moved away from the housing to locate the lever substantially orthogonal to the housing, the first strap engaging end engages the strap and is located away from the lifting end portion, the second strap engaging end being engaged with the strap.

3. The device, according to claim 2, in which the lever is movable towards and away from the housing so as to advance the strap through the housing.

4. The device, according to claim 1, in which:

a) the housing has a base, first and second opposing sidewalls extending generally orthogonally relative to the base, the housing having first and second axes, the first axis being generally orthogonal to the second axis, each sidewall having a connecting slot located therein, each slot being angled away from the first axis; and b) each sidewall includes a guide ramp and a locking opening, the guide ramp being angled towards the locking opening and away from the first axis for receiving the locking portion of the lever.

5. The device, according to claim 4, in which the housing further includes a cross wall connected to, and extending between, the first and second opposing sidewalls, the arm being resiliently connected to the cross wall.

6. The device, according to claim 5, in which a resilient member connects the cross wall and the arm.

7. The device, according to claim 4, in which the lever has two connecting portions extending outwardly therefrom, the connecting portions each being connected to the connecting slots to permit pivotable movement of the lever relative to the housing and to permit axial movement of the lever along the first axis.

8. The device, according to claim 7, in which each connecting portion is a connecting pin.

9. The device, according to claim 4, in which the locking portion of the lever includes two engaging pins extending outwardly therefrom, each engaging pin being sized and shaped to engage the respective guide ramps and to releasably engage the locking openings in the locking position.

10. The device, according to claim 1, in which the arm is Z-shaped in cross section, the lifting portion being disposed towards the lever, the second engaging end being disposed towards the strap, the second engaging portion being substantially parallel to the base and moveable relative thereto.

11. The device, according to claim 10, in which the arm includes an arm axis disposed orthogonal to the base, the lifting portion is a first lip angled towards the base, the second engaging end is a second lip angled away from the base.

12. The device, according to claim 1, in which the first engaging end includes one or more teeth.

13. The device, according to claim 1, in which the first engaging end includes first and second teeth located generally orthogonal to each other for engaging the strap.

14. The device, according to claim 11, in which the second engaging end includes a tooth being connected to a face of the second lip and disposed towards the base.

15. The device, according to claim 1, in which the strap is a ladder strap.

16. The device, according to claim 1, in which the lever has a first surface disposed towards the base, the first surface being shaped to engage the housing so as to define a cavity in the housing.

17. The device, according to claim 1, in which the lever further includes a gripping end, the gripping end being wider than the first strap engaging end to permit a user to move the lever.

18. The device, according to claim 1, in which the buckle is a ratchet-type buckle.

19. The device, according to claim 11, in which the first lip includes a notch for engagement with the first strap engaging end so as to hold the second strap engaging end away from the strap in a release position.

20. A buckle comprising the locking device, as claimed in claim 1.

21. A harness comprising the locking device, as claimed in claim 1.

22. Footwear comprising the locking device, as claimed in claim 1.

23. The footwear, according to claim 22, includes a snowshoe, a ski boot, a hiking boot, a snowboard boot, a rollerblade boot, or ice skates.

* * * * *